US008106597B2

(12) United States Patent
Mednik et al.

(10) Patent No.: US 8,106,597 B2
(45) Date of Patent: Jan. 31, 2012

(54) HIGH EFFICIENCY BOOST LED DRIVER WITH OUTPUT

(75) Inventors: Alexander Mednik, Campbell, CA (US); Rohit Tirumala, Sunnyvale, CA (US)

(73) Assignee: SUPERTEX, Inc., Sunnyvale, CA (US)

( * ) Notice: Subject to any disclaimer, the term of this patent is extended or adjusted under 35 U.S.C. 154(b) by 555 days.

(21) Appl. No.: 12/357,822

(22) Filed: Jan. 22, 2009

(65) Prior Publication Data

US 2009/0184668 A1 Jul. 23, 2009

Related U.S. Application Data

(60) Provisional application No. 61/022,743, filed on Jan. 22, 2008.

(51) Int. Cl.
*H05B 41/24* (2006.01)

(52) U.S. Cl. ..... 315/247; 315/185 S; 315/291

(58) Field of Classification Search ..... 315/185 R, 315/185 S, 246–247, 224–225, 209 R, 291–302, 315/307–311

See application file for complete search history.

(56) References Cited

U.S. PATENT DOCUMENTS

| | | | | |
|---|---|---|---|---|
| 7,295,452 | B1 * | 11/2007 | Liu et al. | 363/82 |
| 2006/0245219 | A1 * | 11/2006 | Li | 363/89 |
| 2007/0152604 | A1 * | 7/2007 | Tatsumi | 315/247 |
| 2009/0212756 | A1 * | 8/2009 | Shao et al. | 323/285 |
| 2009/0302774 | A1 * | 12/2009 | Mednik et al. | 315/209 R |
| 2010/0118572 | A1 * | 5/2010 | Mednik et al. | 363/90 |
| 2010/0259177 | A1 * | 10/2010 | Mednik et al. | 315/185 R |

* cited by examiner

*Primary Examiner* — Shawki S Ismail
*Assistant Examiner* — Jany Tran
(74) *Attorney, Agent, or Firm* — Jeffrey D. Moy; Weiss & Moy, P.C.

(57) ABSTRACT

A current driver for powering a string of LEDs has a boost converter coupled to an input voltage source. A voltage multiplier circuit is coupled to the boost converter and to the string of LEDs. A latch is provided having an output coupled to the boost converter. A current sense element is coupled to the boost converter. A current comparator is provided having an output coupled to a first input of the latch, a first input coupled to the current sense element, and a second input coupled to a reference current. A zero-volt detector circuit is provided having an output coupled to a second input of the latch and an input coupled to the boost converter and the voltage multiplier circuit.

20 Claims, 3 Drawing Sheets

HIGH EFFICIENCY BOOST LED DRIVER WITH OUTPUT

RELATED APPLICATION

The present patent application is related to U.S. Provisional Application Ser. No. 61/022,743, filed Jan. 22, 2008, in the name of the same inventors listed above, and entitled, "HIGH EFFICIENCY BOOST LED DRIVER WITH OUTPUT VOLTAGE MULTIPLIER". The present patent application claims the benefit under 35 U.S.C. §119(e).

BACKGROUND

The present invention relates generally to a Light Emitting Diode (LED) driver and, more specifically, to a switching converter capable of a very high step-up ratio and offering High efficiency at high switching frequency.

Recent developments of light emitting diode (LED) backlights for LCD panel displays in laptops and monitors require driving large arrays of LEDs. In these types of LED arrays, the typical input voltage ranges between 9 and 20V, whereas the total forward voltage of the LED array can exceed 200V.

Common prior art solutions to drive large LED arrays is to use a boost voltage regulator followed by multiple linear current regulators, such that the LED array is broken into a number of LED strings. All of the LED strings are supplied from the output of the boost regulator in parallel. Corresponding linear regulators control the current in each string individually. Driving all LEDs in a single string is a less expensive approach since it requires less circuitry. However, a boost converter is typically quite inefficient at such a high step-up ratio, especially when operated at switching frequencies required to fit the small size constraints typical for LCD screen backlight units (BLU).

Therefore, it would be desirable to provide a circuit and method that overcomes the above problems. The circuit would be a switching converter capable of a very high step-up ratio and offering High efficiency at high switching frequency.

SUMMARY

A current driver for powering a string of LEDs has a boost converter coupled to an input voltage source. A voltage multiplier circuit is coupled to the boost converter and to the string of LEDs. A latch is provided having an output coupled to the boost converter. A current sense element is coupled to the boost converter. A current comparator is provided having an output coupled to a first input of the latch, a first input coupled to the current sense element, and a second input coupled to a reference current. A zero-volt detector circuit is provided having an output coupled to a second input of the latch and an input coupled to the boost converter and the voltage multiplier circuit.

The features, functions, and advantages can be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein.

DETAILED DESCRIPTION

Figure 1:
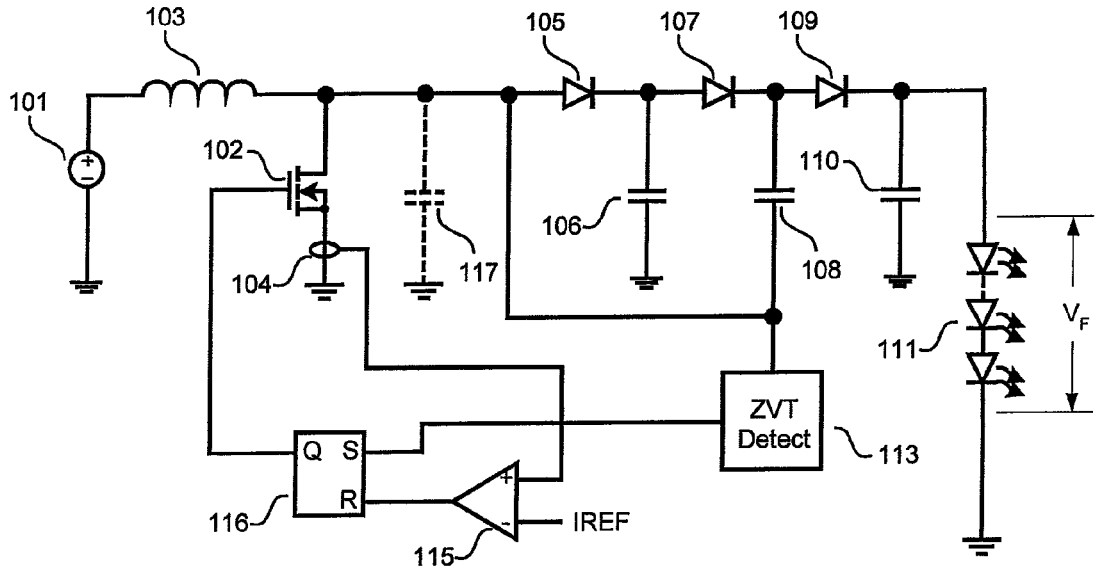
FIG. 1 shows a simplified schematic of an LED driver of the present invention for powering an LED load at constant current.

Referring to FIG. 1, a constant-current driver 100 of the present invention is shown. The driver 100 is used for powering a single string consisting of a large number of LEDs 111 having total forward voltage VF. The driver 100 includes a boost converter 120 which receives its input voltage from an input source 101.

In accordance with one embodiment, the boost converter 120 has an inductor 103, a power switch 102, a rectifier diode 105 and an output filter capacitor 106. The inductor 103 has a first terminal coupled to the input source 101. A second terminal of the inductor 103 is attached to a first terminal of the power switch 102 and to a first terminal of the rectifier diode 105. The output filter capacitor 106 has a first terminal attached to a second terminal of the rectifier diode 105. A second terminal of the rectifier diode 105 is grounded.

The driver 100 also has a voltage doubler circuit comprising of diodes 107 and 109, flying capacitor 108 and output filter capacitor 110. The total parasitic capacitance at the switching node is represented by capacitor 117. The driver also comprises current sense element 104, current comparator 115 with current reference IREF, PWM latch 116 and zero-volt detector circuit 113.

In the present embodiment, a first terminal of the diode 107 is attached to the second terminal of the rectifier diode 105 and to the first terminal of the output filter capacitor 106. A second terminal of the diode 107 is coupled to the first terminal of the diode 109. The flying capacitor 108 has a first terminal coupled to the first terminal of the diode 109 and to the second terminal of the diode 107. A second terminal of the flying capacitor 108 is coupled to the first terminal of the rectifier diode 105. The output capacitor 110 has a first terminal coupled to a second terminal of the diode 109 and a second terminal which is grounded.

The current sense element 104 is coupled to a third terminal of the power switch 102. A current comparator 115 has a first input coupled to the current sense element 104 and a second input coupled to the current reference IREF. The output of the current comparator 115 is coupled to a reset input of the PWM latch 116. The set input of the PWM latch 116 is coupled to the zero-volt detector circuit 113 which is coupled to the second terminal of the flying capacitor 108. The output of the PWM latch 116 is coupled, to the second terminal of the power switch 102.

In operation, when detector circuit 113 detects zero-voltage condition at switch 102, the latch 116 sets, and the switch 102 turns on. At this moment, its body diode has been conducting negative current of inductor 103. Inductor 103 becomes connected across input voltage source 101. The current in inductor 103 ramps up until it exceeds IREF. At this moment, latch 116 resets, and switch 102 turns off. The current of inductor 103 is now charging parasitic capacitance 117 of the switching node and discharging capacitor 108 via diode 109, until diode 105 conducts. The current in inductor 103 ramps down while its energy is transferred to capacitors 106, 108 and 110. When the energy of inductor 103 is fully depleted, its current reverses direction, and diode 105 becomes reverse biased. The current of inductor 103 is now discharging parasitic capacitance 117 of the switching node until diode 107 becomes forward-biased, and the inductor current 103 mainly redirected into the capacitor 108.

The value of capacitor 108 is selected such that the energy stored in parasitic capacitance 117 at the moment when diode 105 conducts exceeds the energy transferred from capacitor 108 to capacitor 110 and LED load 111 while diode 109 is in conduction. Hence, capacitor 108 will continue charging until the body diode of switch 102 conducts, and the switching cycle repeats itself.

One could realize from the above description, that the driver 100 of the present invention features zero-voltage switching transitions in the boost converter stage, as well as zero-current switching transitions in the doubler circuit. Hence, it can be operated at high switching frequency to achieve good efficiency, as well as a very high step-up ratio.

Figure 2:
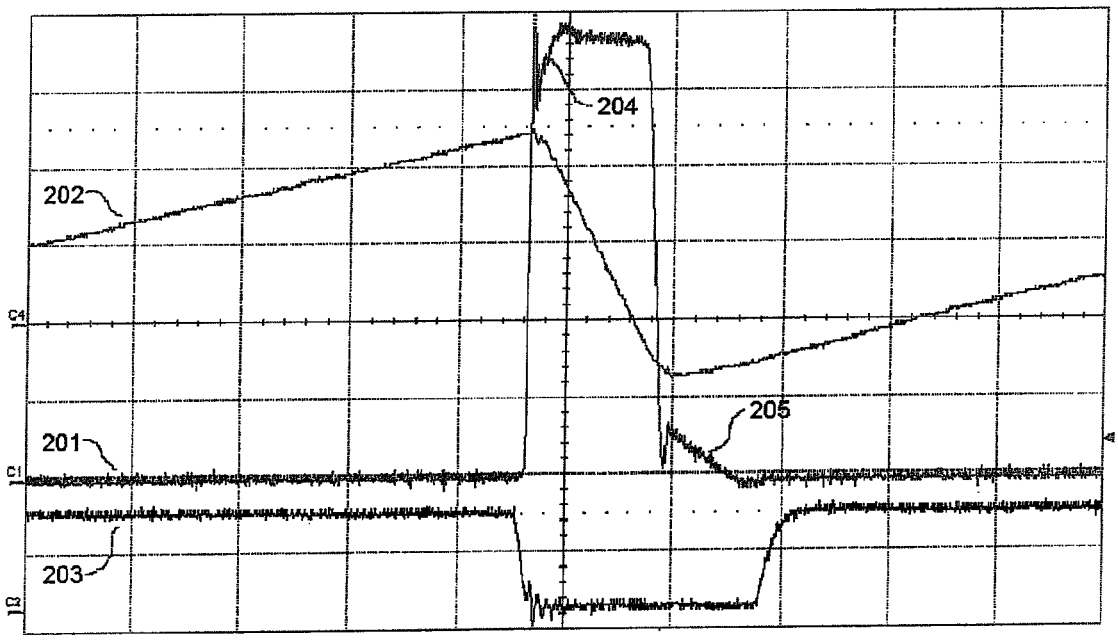
FIG. 2 shows different waveforms of the LED driver depicted in FIG. 1.

Referring to FIG. 2, different waveforms from elements of the driver 100 depicted in FIG. 1 are shown. FIG. 2 shows the waveforms of drain voltage 201 and gate signal 203 of the switch 102, as well as the waveform of the current 202 in the inductor 103. The portions 204 and 205 of drain waveform 201 reflect discharging and charging capacitor 108 correspondingly. Gate signal 203 turns switch 102 on after the charging cycle 205 of capacitor 108 is complete.

Figure 3:
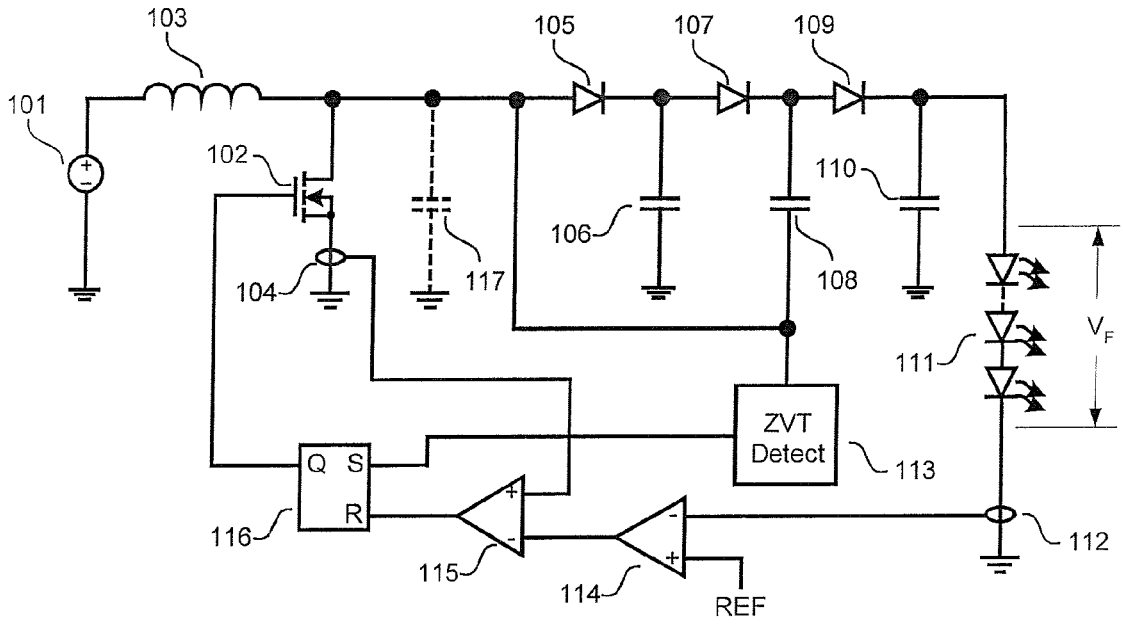
FIG. 3 is another embodiment of the LED driver having a second current sense element and an error amplifier.

Referring to FIG. 3, another embodiment of the driver 100A is shown. The driver 100A is similar to the driver 100. The driver 100A includes the driver 100 of FIG. 1 and further includes a second current sense element 112 and an error amplifier 114. The error amplifier 114 has an output coupled to the second input of the current comparator 115. A first input of the error amplifier 114 is coupled to the second current sense element 112 which is coupled to the LED string 111. The second current sense element 112 is for sensing output LED current. A second input of the error amplifier 114 is coupled to the current reference REF. In operation, the error amplifier 114 generating an error signal proportional to a difference between the current in the LED load 111 and reference level REF. The error signal is used as the current reference IREF of FIG. 1.

Figure 4:
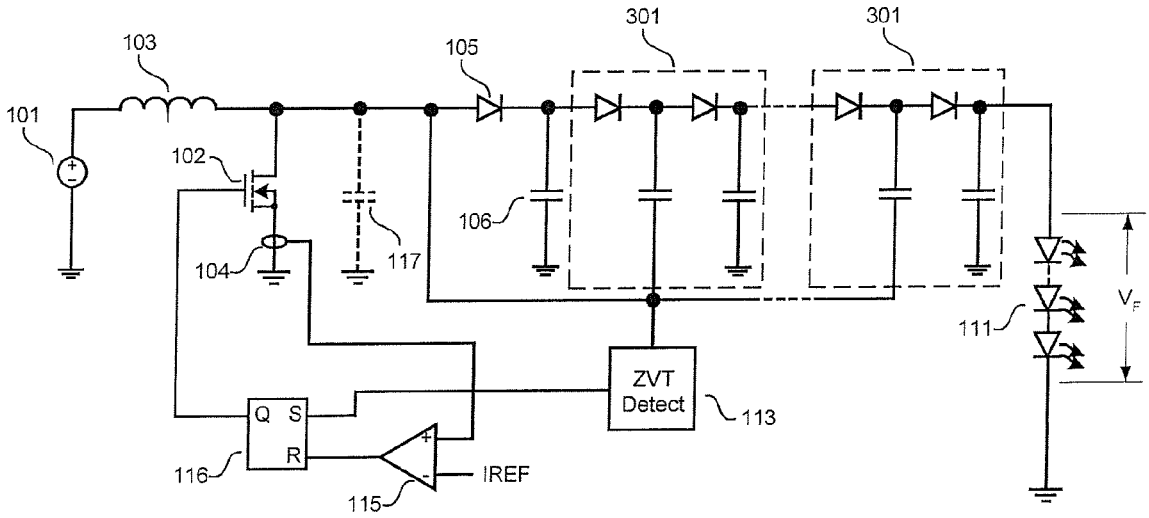
FIG. 4 is another embodiment of the LED driver having a plurality of multiplier stages.

Referring to FIG. 4, another embodiment of the driver 100B is shown. The driver 100B shows the circuit of FIG. 1, wherein the driver 100B further includes a plurality of multiplier stages 301. Each multiplier stage 301 comprises diodes 107 and 109, flying capacitor 108 and output filter capacitor 110. The operation of each multiplier stage is identical to that of the voltage doubler circuit (107, 108, 109, 110) of FIG. 1.

Figure 5:
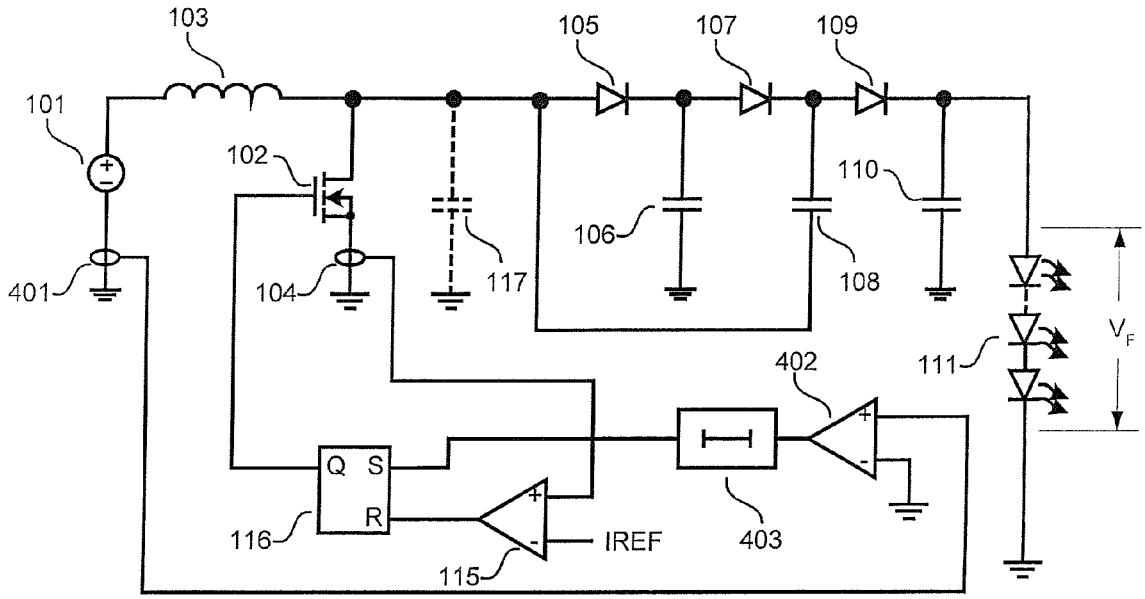
FIG. 5 depicts another embodiment of the LED driver having a zero-current detect circuit.

Referring to FIG. 5, another embodiment of the driver 100D is shown. FIG. 5 depicts the driver 100 of FIG. 1, wherein zero-volt detector circuit 113 is replaced by a zero-current detect circuit, including third current sense element 401 and second current comparator 402. The second current comparator has a first input coupled to the third current sense element 401 ad a second input which is grounded. The driver 100D also includes delay 403 coupled to the output of the second current comparator 402 and to the latch 116.

The operation of the circuit of FIG. 5 is identical to that of the LED driver of FIG. 1 with the exception of the turn-on transition of switch 102. In operation, when the second comparator 402 detects reverse current in the inductor 103 measured by sense 401, latch 116 is set after delay 403. This delay 403 is programmed to be longer than the charging cycle 205, and therefore guaranties that capacitor 108 has been charged fully by the moment switch 102 turns on While embodiments of the disclosure have been described in terms of various specific embodiments, those skilled in the art will recognize that the embodiments of the disclosure can be practiced with modifications within the spirit and scope of the claims.

What is claimed is:

1. A current driver for powering a string of LEDs comprising:

a boost converter coupled to an input voltage source;

a voltage multiplier circuit coupled to the boost converter and to the string of LEDs;

a latch having an output coupled to the boost converter;

a current sense element coupled to the boost converter;

a current comparator having an output coupled to a first input of the latch, a first input coupled to the current sense element, and a second input coupled to a reference current; and a zero-volt detector circuit having an output coupled to a second input of the latch and an input coupled to the boost converter and the voltage multiplier circuit.

2. A current driver for powering a string of LEDs in accordance with claim 1, wherein the boost converter and the multiplier circuit have zero-voltage switching transitions.

3. A current driver for powering a string of LEDs in accordance with claim 1, further comprising a plurality of voltage multiplier circuits.

4. A current driver for powering a string of LEDs in accordance with claim 1, wherein the boost converter comprises:

an inductive element having a first terminal coupled to the input voltage source;

a switching device having a first terminal coupled to a second terminal of the inductive element, a second terminal coupled to the output of the latch and coupled to the current sense element;

a rectifier diode having a first terminal coupled to the second terminal of the inductive element and the first terminal of the switching device, and a second terminal coupled to the voltage multiplier circuit; and an output filter capacitive element having a first terminal coupled to the second terminal to the rectifier diode.

5. A current driver for powering a string of LEDs in accordance with claim 1, wherein the voltage multiplier circuit comprises:

a first diodes having a first terminal coupled to the first terminal coupled to the boost converter;

a second diode having a first terminal coupled to a second terminal of the first diode and a second terminal coupled to the string of LEDs;

a flying capacitor having a first terminal coupled to the second terminal of the first diode and to the first terminal of the second diode; and an output filter capacitor having a first terminal coupled to the second terminal of the second diode and to the string of LEDs.

6. A current driver for powering a string of LEDs in accordance with claim 3, wherein each of the plurality of voltage multiplier circuits comprises:

a first diode having a first terminal coupled to the boost converter;

a second diode having a first terminal coupled to a second terminal of the first diode and a second terminal coupled to the string of LEDs;

a flying capacitor having a first terminal coupled to the second terminal of the first diode and to the first terminal of the second diode; and an output filter capacitor having a first terminal coupled to the second terminal of the second diode and to the string of LEDs.

7. A current driver for powering a string of LEDs in accordance with claim 1, wherein the second input of the comparator is coupled to a current reference source.

8. A current driver for powering a string of LEDs in accordance with claim 1, further comprising:

a second current sense element coupled to the string of LEDs;

a second comparator having an output coupled to the second input of the first comparator, a first input coupled to the second current sense element, and a second input coupled to a reference current source.

9. The power supply of claim 1, wherein the zero-volt detector circuit comprises:

an input current sense element attached to the input voltage source;

a zero-volt detector current comparator having a first input coupled to the input current sense element and a second input coupled to a current reference;

a delay having a first terminal coupled to an output of the zero-volt detector current comparator and a second terminal coupled to the second input of the latch.

10. A current driver for powering a string of LEDs comprising:

a boost converter coupled to an input voltage source;

a voltage multiplier circuit coupled to the boost converter and to the string of LEDs;

a latch having an output coupled to the boost converter;

a current sense element coupled to the boost converter;

a current comparator having an output coupled to a first input of the latch, a first input coupled to the current sense element, and a second input coupled to a reference current; and a zero-volt detector circuit having an output coupled to a second input of the latch and an input coupled to the boost converter and the voltage multiplier circuit;

wherein the boost converter comprises:

an inductive element having a first terminal coupled to the input voltage source;

a switching device having a first terminal coupled to a second terminal of the inductive element, a second terminal coupled to the output of the latch and coupled to the current sense element;

a rectifier diode having a first terminal coupled to the second terminal of the inductive element and the first terminal of the switching device, and a second terminal coupled to the voltage multiplier circuit; and an output filter capacitive element having a first terminal coupled to the second terminal to the rectifier;

wherein the boost converter and the multiplier circuit have zero-voltage switching transitions.

11. A current driver for powering a string of LEDs in accordance with claim 10, further comprising a plurality of voltage multiplier circuits.

12. A current driver for powering a string of LEDs in accordance with claim 10, wherein the voltage multiplier circuit comprises:

a first diodes having a first terminal coupled to the boost converter;

a second diode having a first terminal coupled to a second terminal of the first diode and a second terminal coupled to the string of LEDs;

a flying capacitor having a first terminal coupled to the second terminal of the first diode and to the first terminal of the second diode; and an output filter capacitor having a first terminal coupled to the second terminal of the second diode and to the string of LEDs.

13. A current driver for powering a string of LEDs in accordance with claim 11, wherein each of the plurality of voltage multiplier circuits comprises:

a first diode having a first terminal coupled to the first terminal coupled to the boost converter;

a second diode having a first terminal coupled to a second terminal of the first diode and a second terminal coupled to the string of LEDs;

a flying capacitor having a first terminal coupled to the second terminal of the first diode and to the first terminal of the second diode; and an output filter capacitor having a first terminal coupled to the second terminal of the second diode and to the string of LEDs.

14. A current driver for powering a string of LEDs in accordance with claim 10, wherein the second input of the comparator is coupled to a current reference source.

15. A current driver for powering a string of LEDs in accordance with claim 10, further comprising:

a second current sense element coupled to the string of LEDs;

a second comparator having an output coupled to the second input of the first comparator, a first input coupled to the second current sense element, and a second input coupled to a reference current source.

16. The power supply of claim 10, wherein the zero-volt detector circuit comprises:

an input current sense element attached to the input voltage source;

a zero-volt detector current comparator having a first input coupled to the input current sense element and a second input coupled to a current reference;

a delay having a first terminal coupled to an output of the zero-volt detector current comparator and a second terminal coupled to the second input of the latch.

17. A current driver for powering a string of LEDs comprising:

a boost converter coupled to an input voltage source;

a voltage multiplier circuit coupled to the boost converter and to the string of LEDs;

a latch having an output coupled to the boost converter;

a current sense element coupled to the boost converter;

a current comparator having an output coupled to a first input of the latch, a first input coupled to the current sense element, and a second input coupled to a reference current; and a zero-volt detector circuit having an output coupled to a second input of the latch and an input coupled to the boost converter and the voltage multiplier circuit;

wherein the boost converter comprises:

an inductive element having a first terminal coupled to the input voltage source;

a switching device having a first terminal coupled to a second terminal of the inductive element, a second terminal coupled to the output of the latch and coupled to the current sense element;

a rectifier diode having a first terminal coupled to the second terminal of the inductive element and the first terminal of the switching device, and a second terminal coupled to the voltage multiplier circuit; and an output filter capacitive element having a first terminal coupled to the second terminal to the rectifier diode and a second terminal grounded;

wherein the voltage multiplier circuit comprises:

a first diodes having a first terminal coupled to the first terminal coupled to the boost converter;

a second diode having a first terminal coupled to a second terminal of the first diode and a second terminal coupled to the string of LEDs;

a flying capacitor having a first terminal coupled to the second terminal of the first diode and to the first terminal of the second diode; and an output filter capacitor having a first terminal coupled to the second terminal of the second diode and to the string of LEDs.

18. A current driver for powering a string of LEDs in accordance with claim 17 wherein the boost converter and the multiplier circuit have zero-voltage switching transitions.

19. A current driver for powering a string of LEDs in accordance with claim 17, further comprising a plurality of voltage multiplier circuits.

20. A current driver for powering a string of LEDs in accordance with claim 19, wherein each of the plurality of voltage multiplier circuits comprises:

a first diodes having a first terminal coupled to the boost converter;

a second diode having a first terminal coupled to a second terminal of the first diode and a second terminal coupled to the string of LEDs;

a flying capacitor having a first terminal coupled to the second terminal of the first diode and to the first terminal of the second diode; and an output filter capacitor having a first terminal coupled to the second terminal of the second diode and to the string of LEDs.

* * * * *